US005116189A

United States Patent [19]

Shammout

[11] Patent Number: 5,116,189

[45] Date of Patent: May 26, 1992

[54] LOADER BUCKET WITH POWER LIFT APPARATUS

[75] Inventor: Mohammad Shammout, 3950 Ecochee Ave., San Diego, Calif. 92117

[73] Assignee: Mohammad Shammout, San Diego, Calif.

[21] Appl. No.: 608,709

[22] Filed: Nov. 5, 1990

[51] Int. Cl.[5] ..... B66F 19/00

[52] U.S. Cl. ..... 414/722; 37/DIG. 3; 37/DIG. 12; 414/912; 414/724

[58] Field of Search ..... 414/723, 722, 607, 912, 414/724; 37/117.5, DIG. 3, DIG. 12

[56] References Cited

U.S. PATENT DOCUMENTS

| | | | |
|---|---|---|---|
| 2,816,676 | 12/1957 | Avery et al. | 37/DIG. 3 |
| 3,706,388 | 12/1972 | Westendorf | 214/145 |
| 4,125,952 | 11/1978 | Jennings | 37/117.5 |
| 4,242,035 | 12/1980 | Hornstein | 414/724 |
| 4,355,476 | 10/1982 | Engkvist | 37/DIG. 3 |
| 4,422,819 | 12/1983 | Guest | 414/724 |
| 4,545,721 | 10/1985 | Pettersson | 414/912 X |
| 4,565,485 | 1/1986 | Wilman | 414/704 |

OTHER PUBLICATIONS

Caterpillar Tractor Company Brochure AEDH1315 for the IT28, IT18 and IT12 Cat Integrated Tool Carriers.

Caterpillar, Inc. Brochure AEDH2053 for the IT12, IT18B and IT28B Cat Integrated Tool Carriers (job analysis survey).

Caterpillar Tractor Company Brochure AEDH4713 for the Cat Integrated Tool Carriers.

Caterpillar, Inc. Brochure AEHQ2705 (Aug. 1987) for the IT18B Integrated Tool Carrier.

Caterpillar, Inc. Catalog AECQ8164 of Attachments for Caterpillar Integrated Tool Carriers.

Caterpillar Tractor Company Catalog AEDC4703 for the Cat Track Loaders with Quick Couplers.

Caterpillar, Inc. Catalog AEHQ1217 (May 1987) for TheCAT 973 Track-Type Loader.

JRB Company, Inc. Catalog for JRB Quick Couplers and Attachments for the John-Deere 84 Loader.

Construction Technology, Inc. Catalog for the CTI Fork Attachment Manufactured Under U.S. Pat. No. 3,421,642.

*Primary Examiner*—Robert J. Spar
*Assistant Examiner*—Donald W. Underwood
*Attorney, Agent, or Firm*—Brown, Martin, Haller & McClain

[57] ABSTRACT

A combination attachment for a front-end loader having a lift apparatus attached to a conventional loader bucket is disclosed. The lift apparatus is mounted on the rear wall of the loader bucket and is suited for the lifting, gripping and moving of loads too wide for the loader bucket. The lift can be a conventional pair of fork tines or a platform and is powered by one or more hydraulic cylinders. The lift apparatus is disposed to permit both the lift and the loader bucket to be used simultaneously. The hydraulic cylinders further permit the lift apparatus to grip a load between the loader bucket floor and the lift fork or platform.

9 Claims, 3 Drawing Sheets

FIG. 1
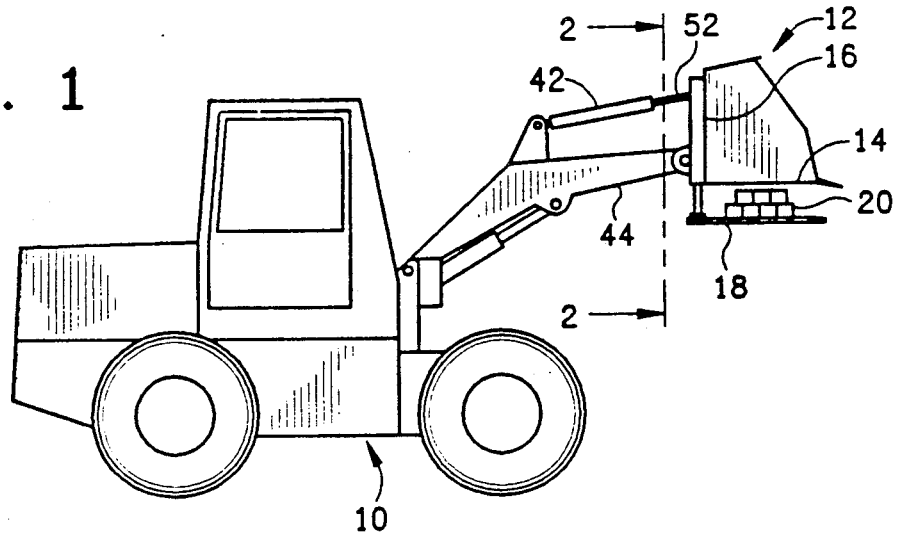
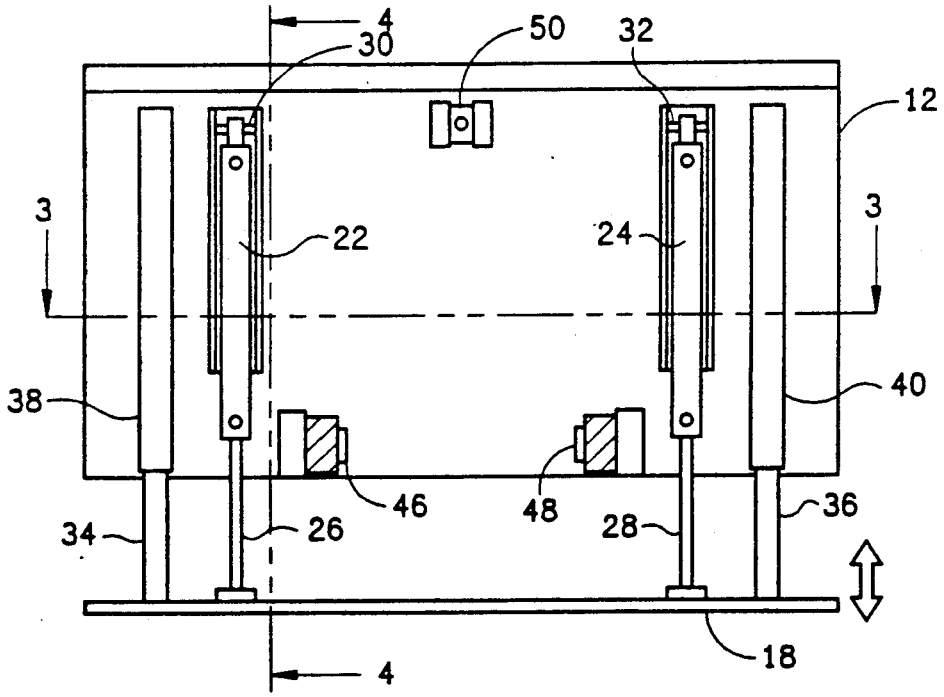
FIG. 2

LOADER BUCKET WITH POWER LIFT APPARATUS

BACKGROUND OF THE INVENTION

1. Field of the Invention

This invention involves a power loader lifting apparatus in general, and, more specifically, a front-end loader bucket implement equipped with a hydraulically-powered lift apparatus for lifting, gripping and carrying loads too wide for the loader bucket.

2. Description of the Related Art

The "front-end loader" is well-known in the art. This is a powered vehicle equipped with at least one hydraulically-powered arm adapted for the attachment of a range of implements. Such implements include powered tools such as earth augers, power chisels, claw-like grippers, and shovels. Other common implements include unpowered devices such as simple lifts, buckets, rakes, and a variety of blades.

Perhaps because of the wide range of implements known in the art, the front-end loader operator is often faced with the task of removing one implement and replacing it with another during the course of his work. For instance, the typical loader buckets used in the loading of earth-hauling equipment with sand, gravel and landfill are not suited for handing nonparticulate materials. The loader operator is obliged to remove the loader bucket and attach a lift fork or a powered gripper when her task shifts from loading particulate materials to unloading pallets or bales. This inconvenience and inefficiency is well-known in the art and has motivated a number of practitioners to develop improvements to the standard implements.

The intent of many such implement improvements is to increase the efficiency of the front-end loader operation by reducing or eliminating the time required to change implements during the job. Several implements are known for use as temporary attachments to a loader bucket. These usually are fork lift attachments adapted for rapid mounting on a loader bucket. Some may require a special supporting structure on the bottom of the loader bucket. Most such add-on fork lifts are designed to effectively extend the bucket bottom to form a lift platform at the front edge of the bucket. This extended-bucket lift is then powered by the front-end loader arm in the normal manner. The bucket is normally rendered useless when the lift attachment is in place.

In U.S. Pat. No. 3,706,388, Westendorf discloses a fork attachment for a loader bucket that is quickly and easily attached to the loader bucket to permit the loader bucket to be used as a loader fork. Westendorf's design requires the interior of the loader bucket to remain clear of material and limits the fork lift load width to the width of the loader bucket.

In U.S. Pat. No. 4,125,952, Jennings discloses an attachment fork for power-operated buckets that is designed to cantilever from the leading edge of the bucket. Jennings accomplishes this by providing hinge components for attachment to the back wall of the bucket, which serve to ensure a secure and rigid attachment without weakening the bucket structure. Jennings' invention is unsuited for lifting loads having widths wider than the bucket width.

In U.S. Pat. No. 4,242,035, Hornstein discloses apparatus for converting a curved scoop-type loader bucket to a pallet loader through attachment of two identical tine harnesses. Hornstein merely clamps two tines to the loader bucket with chains, thereby adding a fork extension to the bottom of the loader bucket. His means for attachment prevents use of the loader bucket while the fork tines are attached.

In U.S. Pat. No. 4,422,819, Guest discloses a fold-away fork lift attachment for loader buckets. Guest's invention is designed for permanent attachment to the upper inner wall of the loader bucket. When the loader bucket is in use, the two fork tines are folded up against the inner upper wall of the loader bucket. When the two forks are folded down for use as a fork lift, the loader bucket is blocked and not usable.

In U.S. Pat. No. 4,545,721, Pettersson discloses a device having both a loader bucket and a fork lift. Pettersson's loader bucket is hinged and rests on the fork lift during use as a loader bucket. When Pettersson's invention is used as a fork lift, the loader bucket portion is tilted back by independent hydraulically-powered means, thereby exposing the fork lift on which the bucket normally rests. Pettersson's invention does not permit the simultaneous use of both bucket and lifting fork.

In U.S. Pat. No. 4,565,485, Willman discloses a mechanical grab and scoop combination for use with a front-end loader that overcomes the normal requirement for two separate devices for grasping and scooping operations. Willman's invention consists of upper and lower toothed grab elements that form a scoop bucket when fully closed together. When these two elements are fully separated, the lower grab element can serve as an awkward fork lift. Willman's invention does not permit the simultaneous use of a bucket and fork lift.

The wide range of front-end loader implements known in the art attests to the widely- and strongly-felt need for implements leading to efficient loader operation through multiple functionality. Most of the implements known in the art require the loader operator to change implements, add attachments, or switch configurations when changing the job function. Three common front-end loader functions are the lift fork function, the loader bucket function, and the grabber function. There is a need for a front-end loader implement offering all three such functions simultaneously without functional limitations imposed by such a combination. Although such simultaneous functionality can be provided with three different vehicles, until now, such a combination in a single loader implement has been unknown in the art. These unresolved problems and deficiencies are clearly felt in the art and are solved in the present invention in the manner described below.

SUMMARY OF THE INVENTION

My invention combines a lift attachment and a loader bucket through the addition of a powered lift attachment to the rear wall of the loader bucket. The lift attachment can be a pair of fork tines or a platform that enables the lifting and transport of items too wide for the loader bucket. The lift attachment is controlled by hydraulic means independent of the loader arm power means and includes telescopic guides mounted on the rear of the loader bucket to stabilize and strengthen the lift during use.

An important feature of my invention is the capability of simultaneous use of the loader bucket to move particulate matter and the lift means to move materials such as piping, pallets and the like. Another important feature of my invention is the capability for grabbing and holding materials between the lift means and the bottom of the loader bucket. This capability results from the independent hydraulic power means provided for the lift attachment. Another important feature of my invention is the capacity for using all three functions simultaneously; that is, the loader bucket, the lift means and the gripping capability.

An advantage of my invention is that most existing loader buckets can be modified to include my lift and grip invention, provided that the loader bucket either has a substantially flat back wall or surface on which to attach my lift apparatus or is fitted with adapters to provide such a flat surface in the manner disclosed below. Another important advantage of my invention is that all three functions are available without requiring the loader operator to change configurations or attachments. The foregoing, together with other features and advantages of my invention, will become more apparent when referring to the following specifications, claims and accompanying drawings.

BRIEF DESCRIPTION OF THE DRAWINGS

For a more complete understanding of the present invention, reference is now made to the following detailed description of the embodiment illustrated in the accompanying drawings, wherein:

FIG. 1 shows a side elevation view of a typical front-end loader with my power lift platform mounted on the existing loader bucket;

FIG. 2 is an enlarged sectional view from the rear of the loader bucket assembly taken on line 2—2 from FIG. 1;

DESCRIPTION OF THE PREFERRED EMBODIMENT

Figure 3:
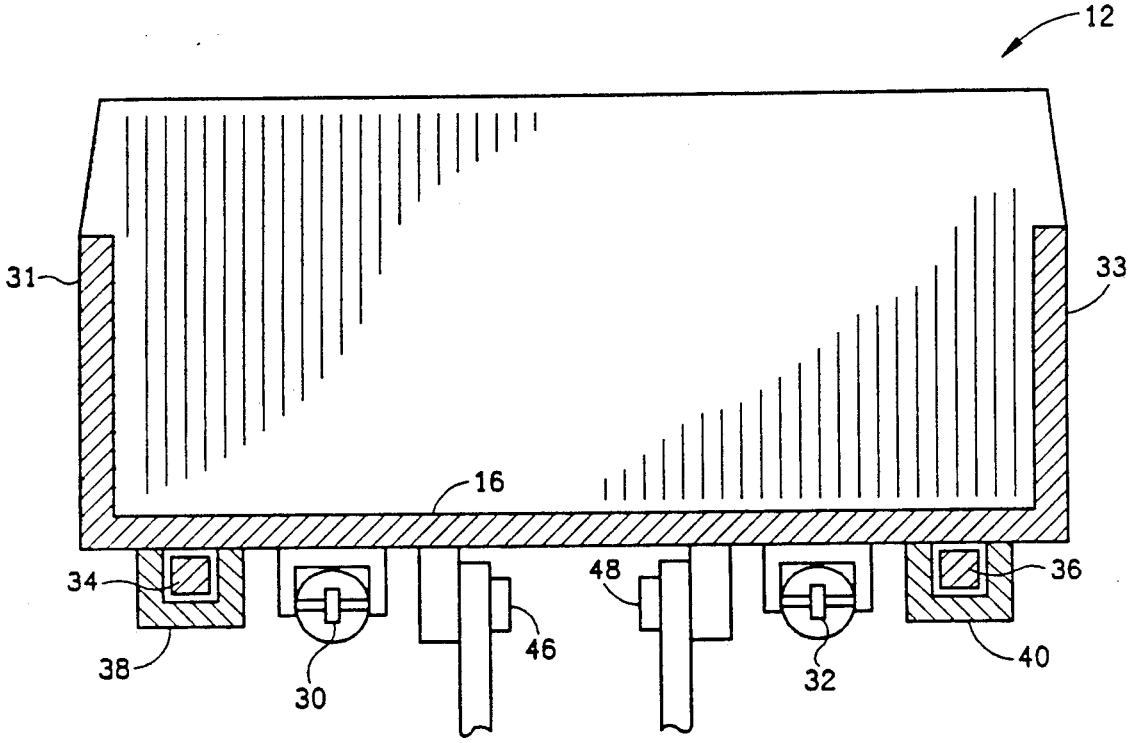
FIG. 3 is a sectional view of the loader bucket assembly taken on line 3—3 from FIG. 2.

FIG. 1 shows a typical front-end loader 10 equipped with a loader bucket 12 of a type having a substantially flat floor or bottom wall 14 and a substantially flat rear wall 16. In FIG. 1, bucket 12 is shown equipped with my lift apparatus invention, which includes lift platform 18. FIG. 1 shows lift platform 18 loaded with a stack of material 20 in a manner substantially as would occur in actual use. Because material stack 20 is carried below bucket 12, the width of material stack 20 is not limited to the distance between the sidewalls 31 and 33 (FIG. 3) of bucket 12.

FIG. 2 shows a view of the bucket and lift apparatus taken along line 2—2 in FIG. 1. Lift platform 18 can be raised or lowered, as indicated by the double headed arrow, through the action of the two hydraulic cylinders 22 and 24. Each hydraulic cylinder 22 and 24 comprises a hydraulic piston 26 and 28 attached to lift platform 18, whereby platform 18 is raised or lowered in response to pressure changes in hydraulic cylinders 22 and 24. The changes in hydraulic pressure within cylinders 22 and 24 is effected by connecting them to the front-end loader hydraulic pressure pump (not shown) by means of the hydraulic hoses 54 and 56 (FIG. 4) in a manner known in the art.

Hydraulic cylinders 22 and 24 are anchored at the two hinge joints 30 and 32 respectively. Hinge joints 30 and 32 are mounted on back wall 16 of bucket 12. The raising and lowering action of hydraulic cylinders 22 and 24 serve to raise and lower lift platform 18 with respect to bucket 12. This allows floor 14 and lift platform 18 to function as two jaws of a grabber, whereby materials can be seized and held between floor 14 and platform 18 for transportation. The open sides beneath floor 14 permit the seizure and transportation of loads wider than the distance between sidewalls 31 and 33 of bucket 12.

An important feature of my invention is the two guide bars 34 and 36 which act to guide the movement of platform 18 as it is raised and lowered. Guide bars 34 and 36 move in and out of the guide slots 38 and 40 respectively. Guide bars 34 and 36 add substantial strength and stability to lift platform 18 during operation and allow the lift and grab functions to be performed even when bucket 12 is tilted with respect to the horizontal.

Bucket 12 can be tilted with respect to the horizontal by operation of the hydraulic cylinder 42 shown in FIG. 1. Bucket 12 is attached to front end loader lift arm 44 at the two hinge joints 46 and 48 (FIG. 2). Hydraulic cylinder 42 is attached to bucket 12 at a third hinge joint 50 (FIG. 2) and bucket 12 can be tilted around the hinge joints 46 and 48 by applying hydraulic pressure to hydraulic cylinder 42 to force a hydraulic piston 52 to move hinge joint 50 back and forth in a manner known in the art.

In FIG. 3, the guides and hinges discussed above can be viewed from the top of loader bucket 12. The cross-section of guide bars 34 and 36 is shown as substantially square, but may be round or rectangular if sized as required for the necessary strength. The strength of guide bars 34 and 36 need only be sufficient to maintain stability of lift platform 18 with respect to loader bucket 12 because the primary support and power to lift platform 18 is provided by hydraulic cylinders 22 and 24 attached to hinge joints 30 and 32.

Figure 4:
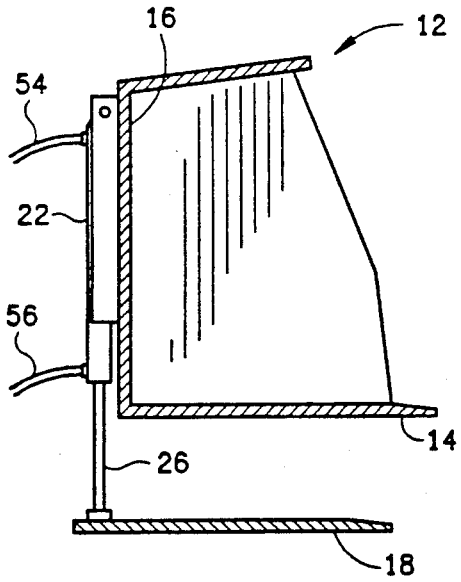
FIG. 4 is a sectional view of the loader bucket assembly taken from line 4—4 from FIG. 2.

In FIG. 4, the bucket and lift platform apparatus can be viewed from the side. Hydraulic hoses 54 and 56 provide the hydraulic pressure required for operation of hydraulic cylinder 22. Two other such hoses (not shown) are provided for hydraulic cylinder 24. My invention actually requires only a single hydraulic cylinder for proper operation, but I prefer the use of two hydraulic cylinders because of the improvement in stability and balance resulting from that configuration.

Figure 5:
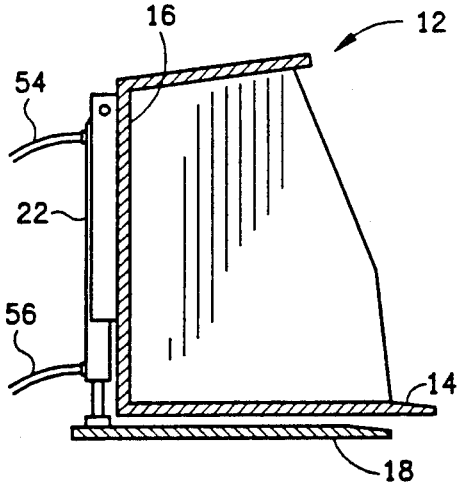
FIG. 5 is a view from the side of the loader bucket assembly, similar to FIG. 4, with the lift means retracted against the loader bucket bottom.

Referring to FIG. 5, lift platform 18 is shown fully raised against bottom 14 of lift bucket 12. Note that the front edge of bottom 14 extends out over the top of the front edge of platform 18. This relationship between the two edges permits the loader operator to fill bucket 12 by pushing the front edge of bottom 14 under the particulate material to be lifted, without interference from lift platform 18. Once bucket 12 is filled, the operator can lift and tilt the bucket to hold the particulate load, while lowering lift platform 18. Platform 18 can then be used to lift a load of bars, boards or the like while bucket 12 remains fully loaded. Once loaded, lift platform 18 can then be lifted to grip load 20 (FIG. 1) against bottom 14. The loader operator may then proceed to his destination carrying a fully loaded bucket and a fully loaded lift platform at the same time. This capability for simultaneous use of lift platform and bucket is an important advantage of my invention.

Figure 6:
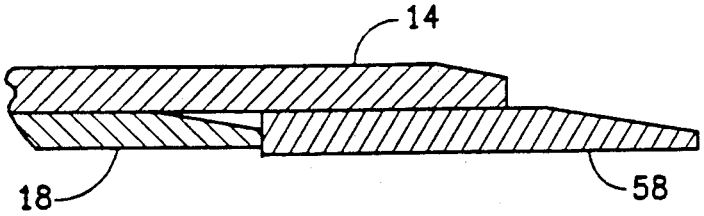
FIG. 6 is a close up view of the leading edge of the bucket shown in FIG. 5, showing the retracted lift means flush behind a digging tooth attachment secured to the bucket lip.

In FIG. 6, I show a close up of a bucket lift having a digging tooth attachment 58 fixed to the edge of the lip in a manner known in the art. As seen in the diagram, lift platform 18 can be disposed to fit behind and flush with tooth attachment 58. This is an alternate embodiment of the feature discussed above that prevents damage to and obstruction by lift platform 18 during digging and scooping operations using bucket 12.

Figure 7:
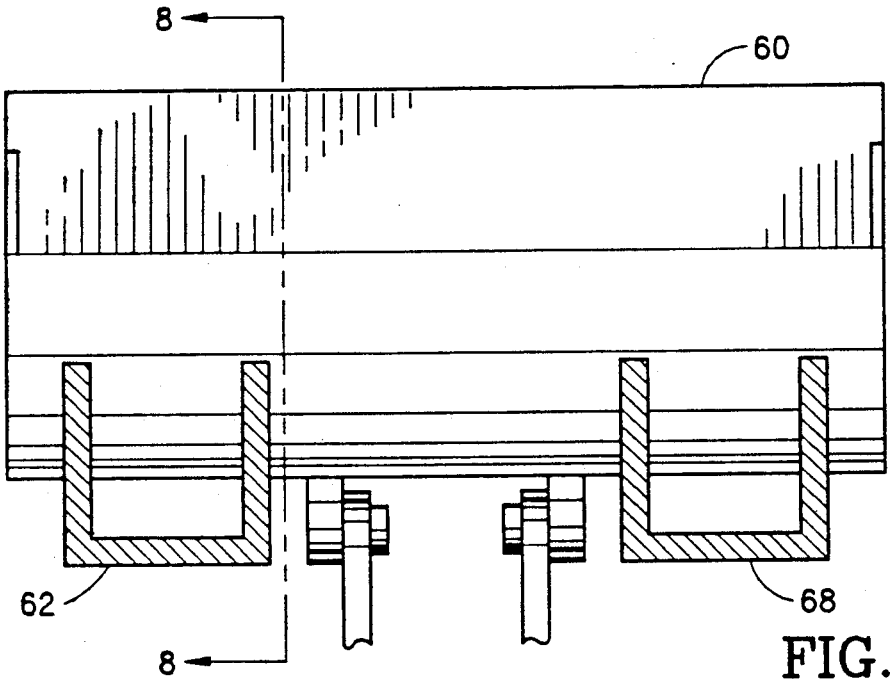
FIG. 7 is a top view of a curved bucket fitted with adapters to provide a flat mounting surface for the present invention.
Figure 8:
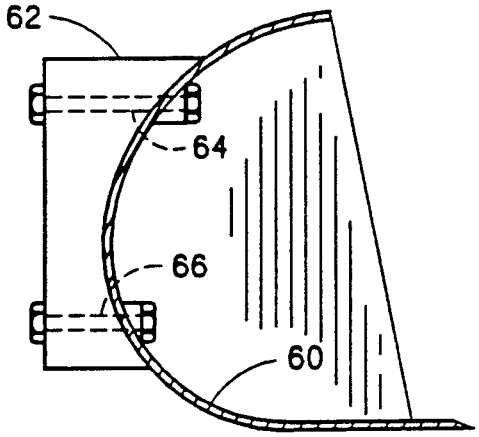
FIG. 8 is a view of the curved bucket taken from line 8—8 from FIG. 7.

While my preferred embodiment makes use of an existing loader bucket having a substantially flat wall 16, it may also be fitted to the round loader buckets known in the art. FIG. 8 shows a round loader bucket 60 fitted with an adaptor member 62 by means of the two through-bolts 64 and 66. Referring to FIG. 7, round loader bucket 60 is shown in a top view having adaptor members 62 and 68 positioned to form a flat mounting surface for the mounting of the hydraulic cylinders and telescopic guides making up my invention (not shown). Reference to FIG. 3 illustrates the placement of hydraulic cylinders 30 and 32 and guides 38 and 40 and teaches my invention sufficiently for installing on the adaptor members 62 and 68 as shown in FIG. 7. Members 62 and 68 are firmly attached to bucket 60 in FIG. 7 by means of through-bolts (not shown) in the manner illustrated in FIG. 8.

Obviously, other embodiments and modifications of the present invention will occur readily to those of ordinary skill in the art in view of these teachings. Therefore, my invention is to be limited only by the following claims, which include all such obvious embodiments and modifications when viewed in conjunction with the above specification and accompanying drawings.

I claim:

1. A combined bucket and lift apparatus for attachment to a vehicle, comprising:

a loader bucket having a bottom wall;

a lifting member; and support means for adjustably suspending said lifting member below said loader bucket in a plane substantially parallel to said bucket bottom wall;

said support means comprising hydraulic means secured between said bucket and said lifting member for raising and lowering said lifting member parallel to the bottom wall of the bucket to allow materials to be lifted and held between the lifting member and the bottom wall of the bucket.

2. The apparatus as claimed in claim 1, wherein said support means additionally comprises telescopic guide means secured between said lifting member and said bucket for slidably guiding said lifting member for movement parallel to said bucket bottom wall.

3. The apparatus as claimed in claim 2, wherein said bucket has a rear wall extending substantially perpendicular to said bottom wall, and said lifting member has a rear edge, said telescopic guide means extending between said bucket rear wall and said rear edge of said lifting member in a direction perpendicular to the plane of said lifting member, and comprising a first part projecting upwardly from the rear edge of said lifting member and a second part secured to said bucket rear wall, one of said parts comprising a guide bar and the other part comprising a hollow tubular member for slidably receiving said guide bar.

4. The apparatus as claimed in claim 3, including a pair of spaced telescopic guide means extending between said bucket rear wall and lifting member rear edge, each guide means comprising a guide bar and a hollow tubular member for telescopic sliding engagement with said guide bar.

5. The apparatus as claimed in claim 1, wherein said hydraulic means comprises at least one hydraulic cylinder and piston secured between said bucket and lifting member and extending perpendicular to said bucket bottom wall and lifting member.

6. The apparatus as claimed in claim 1, wherein said lifting member comprises a lifting fork.

7. The apparatus as claimed in claim 1, wherein said lifting member comprises a lifting plate.

8. A lifting and grappling apparatus for attachment to a loader bucket, comprising:

a planar lifting member;

suspending means for suspending the lifting member from a loader bucket in a plane parallel to the bottom wall of the bucket, the suspending means comprising a hydraulic lifting mechanism secured at one end to said lifting member and having mounting means at the other end for mounting on a rear surface of a loader bucket, the lifting mechanism comprising means for raising and lowering said lifting member relative to the bottom wall of a loader bucket to allow materials to be lifted and held between the bottom wall of the bucket and the lifting member.

9. A combined bucket and lift apparatus for attachment to a vehicle, comprising:

a loader bucket having a bottom wall;

a lifting member;

suspending means connected between the loader bucket and lifting member for adjustably suspending the lifting member below the bucket in a plane substantially parallel to the bottom wall of the bucket;

the suspending means comprising hydraulic means extending perpendicular to said lifting member for raising and lowering said lifting member in planes parallel to the bottom wall of the bucket and at least one telescopic guide means extending transversely between the bucket and lifting member for guiding said lifting member as it moves up and down, said guide means comprising a first part secured to the bucket and a second part secured to the lifting member, one of the parts comprising a guide bar and the other part comprising a hollow tubular member for telescopic sliding engagement with said guide bar.

* * * * *